US009562357B1

(12) United States Patent
Harp

(10) Patent No.: US 9,562,357 B1
(45) Date of Patent: Feb. 7, 2017

(54) ROOFING MEMBRANE TENSIONER, METHOD AND SYSTEM

(71) Applicant: Daniel L. Harp, Aurora, MN (US)

(72) Inventor: Daniel L. Harp, Aurora, MN (US)

( * ) Notice: Subject to any disclaimer, the term of this patent is extended or adjusted under 35 U.S.C. 154(b) by 0 days.

(21) Appl. No.: 14/855,373

(22) Filed: Sep. 15, 2015

Related U.S. Application Data

(60) Provisional application No. 62/050,297, filed on Sep. 15, 2014.

(51) Int. Cl.

| | |
|---|---|
| ***E04D 15/06*** | (2006.01) |
| ***E04D 15/04*** | (2006.01) |
| ***E04D 12/00*** | (2006.01) |
| ***E04D 13/16*** | (2006.01) |

(52) U.S. Cl.
CPC ..... *E04D 15/06* (2013.01); *E04D 12/002* (2013.01); *E04D 13/1618* (2013.01); *E04D 13/1625* (2013.01); *E04D 15/04* (2013.01); *B65H 2701/1922* (2013.01)

(58) Field of Classification Search
CPC .. E04D 15/06; E04D 13/1618; E04D 13/1625; E04D 12/002; E04D 15/04; B65H 2701/1922; B65H 16/08
See application file for complete search history.

(56) References Cited

U.S. PATENT DOCUMENTS 5,561,959 A * 10/1996 Alderman ..... E04D 15/06 52/404.1
5,685,123 A * 11/1997 Alderman ..... E04D 15/06 242/557
6,247,288 B1 * 6/2001 Harkins ..... E04D 15/06 52/746.11
(Continued)

*Primary Examiner* — Andrew J Triggs
(74) *Attorney, Agent, or Firm* — Avery, Whigham & Winesett, P.A.; Nathan Stamey Winesett

(57) ABSTRACT

The invention provides for a roofing membrane tensioner 10 having a base 102 with a hook 36 for catching the edge 22 of an underlying surface 20, a membrane connector 108, and a means for moving the membrane connector towards the edge by applying force inwardly 24 from the edge. The means for moving the membrane connector towards the edge can be a lever 104 operated substantially in the same plane as the underlying surface. The force can be applied at least 50 cm from the edge. The base can have a flat side and a hook side. The base can also have a mount 110 for connecting the lever. The mount can be the fulcrum 110 for the lever.

The invention also provides for a method for tensioning a roof membrane 40 towards an edge 22 of a roof surface 20 by securing a preceding tab 41 of the roof membrane to the roof surface, hooking a slidable base 102 having a fulcrum 110 for an attached lever 104 to the edge, connecting a membrane connector 108 between a subsequent tab of the roof membrane and the lever on one side of the fulcrum, and tensioning the roof membrane by applying inwardly 24 directed effort to the lever on the other side of the fulcrum.

The invention also provides for a roof membrane tensioning system 10 having a mounting means for positioning and adjusting a base 102 on a roof 20, a membrane connector 108, and a membrane tensioning mechanism for tightening the membrane towards an edge of a roof by applying force inwardly 24 from the edge 22.

12 Claims, 7 Drawing Sheets

(56) References Cited

U.S. PATENT DOCUMENTS

| | | | | |
|---|---|---|---|---|
| 6,308,489 | B1 * | 10/2001 | Romes | E04D 15/06 52/742.12 |
| 6,393,797 | B1 * | 5/2002 | Romes | B65H 16/00 242/566 |
| 6,595,455 | B2 * | 7/2003 | Romes | B65H 16/08 242/422.5 |
| 6,705,059 | B2 * | 3/2004 | Romes | E04F 21/00 242/566 |
| 7,665,576 | B2 * | 2/2010 | Pelletier | E04G 3/26 182/45 |
| 8,146,709 | B2 * | 4/2012 | Pelletier | E04G 3/26 182/45 |
| 8,528,301 | B1 * | 9/2013 | Robbins | E04D 13/1625 242/566 |
| 8,596,415 | B2 * | 12/2013 | Pelletier | E04G 3/26 182/45 |
| 8,887,782 | B2 * | 11/2014 | Bessette | B29C 63/0065 156/497 |
| 2002/0050543 | A1 * | 5/2002 | Romes | B65H 16/08 242/422.5 |
| 2003/0056464 | A1 * | 3/2003 | Romes | E04F 21/00 52/749.12 |
| 2010/0071291 | A1 * | 3/2010 | Berkowitz | E04D 5/02 52/408 |

* cited by examiner

ROOFING MEMBRANE TENSIONER, METHOD AND SYSTEM

CLAIM OF PRIORITY

This application is based on and claims the benefit of priority from U.S. provisional application No. 62/050,297 filed Sep. 15, 2014.

STATEMENT REGARDING FEDERALLY SPONSORED RESEARCH/DEVELOPMENT

Not Applicable.

BACKGROUND OF THE INVENTION

Field of the Invention

The present invention relates generally to a device, method, and system for pulling roofing membranes taut. More particularly, the present invention relates to a roofing membrane tensioner, method, and system.

Related Art

Roof construction can make use of membrane or sheet materials, such as scrim-reinforced membranes. Proper installment of these materials can include the tensioning of the material over the underlying roof surface to eliminate wrinkles or looseness. Installment can be made by laying the material over the roof, securing the material to the roof surface, and tensioning the material across the roof progressively in successive stages. When near the edge of the roof, this act of tensioning can involve stretching the material towards the edge. Stretching the material towards the edge can be problematic. Working near the edge of a roof can be a safety hazard. The use of tools that involve a worker applying force towards the edge and in a standing position to stretch the material can lead to a possible dangerous situation if the something goes wrong. If something breaks, tears, or slips, the applied force could send a worker over the edge of the roof. Additionally, it can be difficult to find a suitable location to set the tool when there is insufficient roof surface between the fabric and the edge of the roof. Tools can be used improperly or in awkward positions, which can decrease usability, effectiveness, and safety.

SUMMARY OF THE INVENTION

It has been recognized that it would be advantageous to develop a roofing membrane tensioner, method, and system where the worker applies force directed inwardly from the edge of the roof. It has further been recognized that it would be advantageous to have a tool for tensioning the membrane that can be easily and quickly operated, relocated down the edge of the roof, and operated in a kneeling position.

The invention provides for a roofing membrane tensioner having a base with a hook for catching the edge of an underlying surface, a membrane connector, and a means for moving the membrane connector towards an edge by applying force inwardly from the edge. The means for moving the membrane connector towards the edge can be a lever operated substantially in the same plane as the underlying surface. The force can be applied at least 50 cm from the edge. The base can have a flat side for anchoring to the middle of the underlying surface and a hook side for anchoring to the edge of the underlying surface. The base can also have a mount for connecting the lever. The mount can be the fulcrum for the lever. The lever can be configured to be slidably adjustable on the mount. The mount can have multiple mounting locations. The base can be configured to be slidable for repositioning the base on the underlying surface. The base can also be configured to be teethlessly anchored to the underlying surface. The base can have a large flat and smooth surface area for anchoring to the underlying surface. The membrane connector can have an adjustable length.

The roofing membrane tensioner can also have a parapet wall adapter for securing the base to a vertically-oriented underlying surface. The parapet wall adapter can be configured to removably attach to the base and to clamp the vertically-oriented underlying surface to the base.

The invention also provides for a method for tensioning a roof membrane towards an edge of a roof surface by securing a preceding tab of the roof membrane to the roof surface, hooking a slidable base having a fulcrum for an attached lever to the edge, connecting a membrane connector between a subsequent tab of the roof membrane and the lever on one side of the fulcrum, tensioning the roof membrane by applying inwardly directed effort to the lever on the other side of the fulcrum, and securing the subsequent tab to the roof surface.

The invention also provides for a roof membrane tensioning system having a mounting means for positioning and adjusting a base on a roof, a membrane connector, and a membrane tensioning mechanism for tightening the membrane towards an edge of a roof by applying force inwardly from the edge.

Additional features and advantages of the invention will be apparent from the detailed description which follows, taken in conjunction with the accompanying drawings, which together illustrate, by way of example, features of the invention.

DETAILED DESCRIPTION

Figure 1:
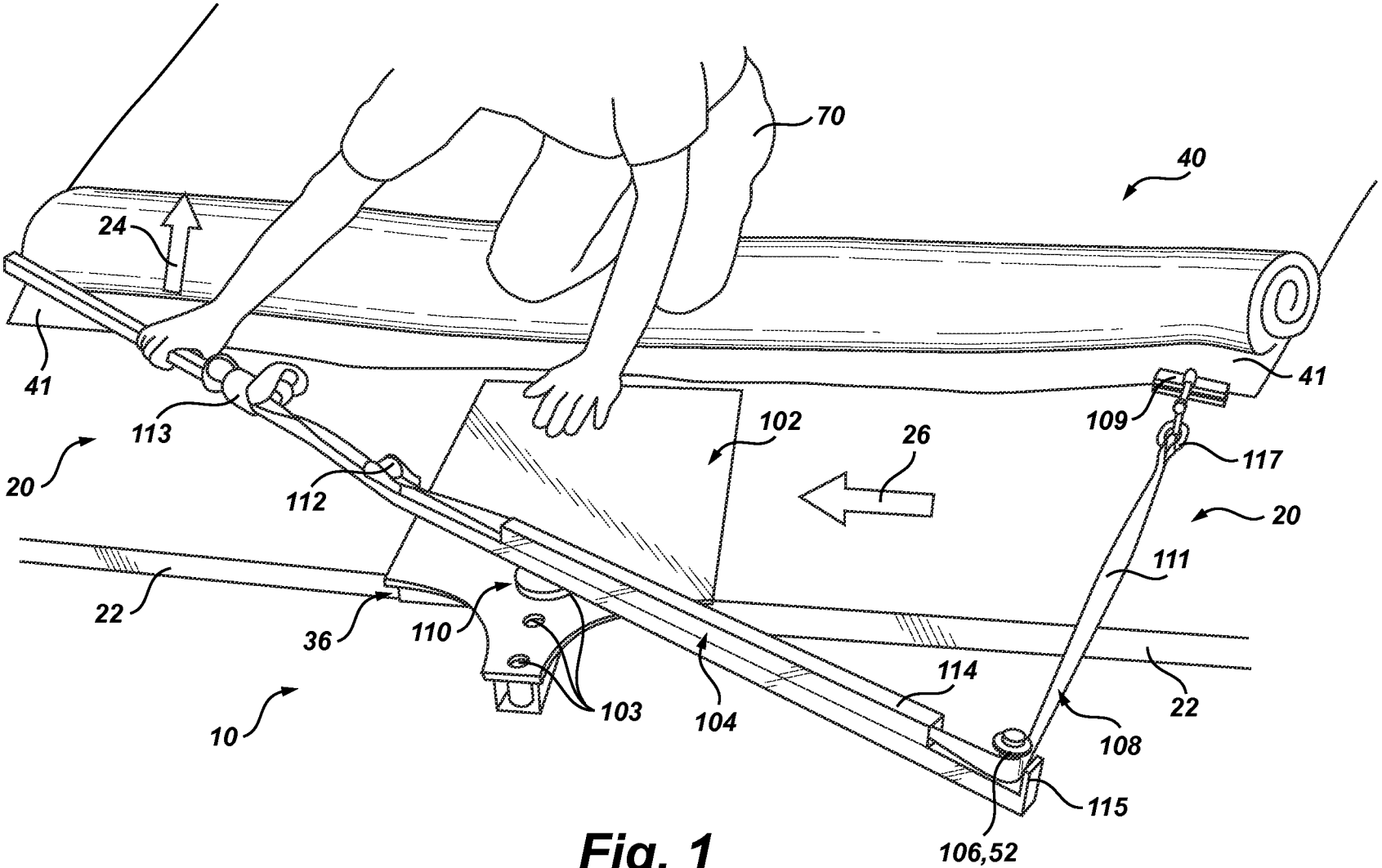
FIG. 1 shows a top perspective view of a roofing membrane tensioner in accordance with an embodiment of the invention being used by an operator to tension a roof membrane that is located further back from the edge of a roof, and showing the hook anchored on the roof edge and the operator of the device pulling on the lever from the right side inwardly from the roof edge while kneeling at least 50 cm away from the edge.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in the Figures, the invention provides for a roofing membrane tensioner, indicated generally at 10, having a base 102, a membrane connector 108, and a means for moving the membrane connector towards the edge 22 of an underlying surface 20 by applying force inwardly 24 from the edge. For example, the roofing membrane tensioner can tighten single-ply roofing membranes or scrim-reinforced membranes 40. By applying the force inwardly, a user can more safely tighten a membrane when installing membranes near the edge 22 of a roof 20.

Figure 2:
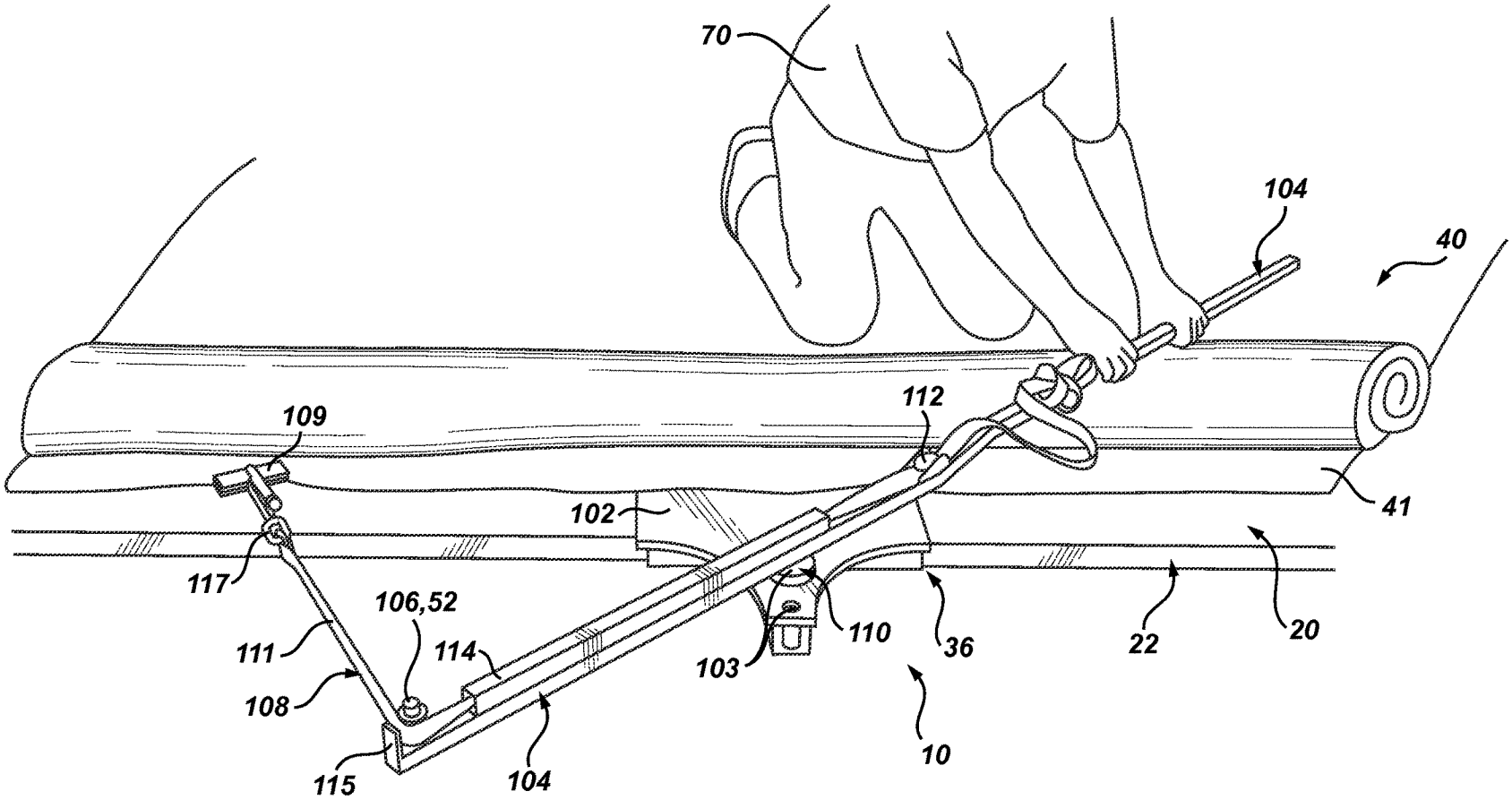
FIG. 2 shows a top perspective view of the roofing membrane tensioner of FIG. 1, being used by an operator to tension a roof membrane located very close to the edge of a roof, showing the hook anchored on the roof edge and base under the membrane and the operator of the device pulling on the lever from the left side inwardly from the roof edge while kneeling at least 50 cm away from the edge.
Figure 3:
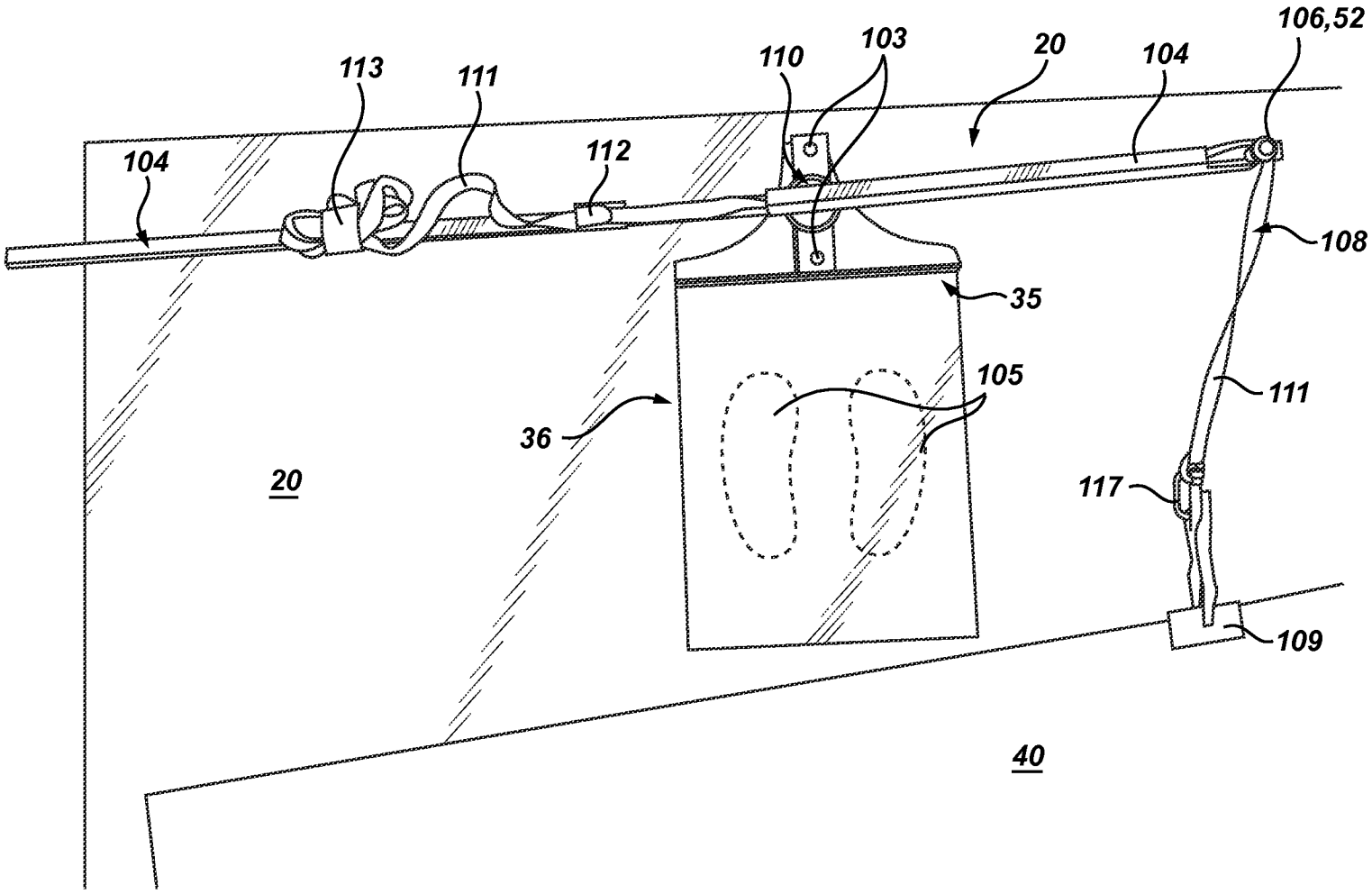
FIG. 3 shows a bottom perspective view of the roofing membrane tensioner of FIG. 1, with the base being used upside down in the middle of the roof to tension a roof membrane with the flat side of the base against the underlying surface and the lever mounted through the bottom of the mount, said base can be anchored to the roof surface by applying weight such as by kneeling on the plate.

The base 102 can be configured to engage the underlying surface 20 to provide an anchor to operate the device. The base can be held tight to the roof surface 20 through normal or friction forces. For example, the base can be anchored to the roof edge 22 by a hook 36 as shown in FIGS. 1 and 2 and/or kneeled on 105 and held to the roof surface while operating the device as shown in FIG. 3. The membrane connector 108 can be configured to removably attach to membranes 40 and to the mechanism for moving and tensioning the membrane towards the edge 22 of the roof 20. This means can be a lever 104 that uses a mount 103 on the base 102 as a fulcrum 110.

The base 102 can be configured from a plate that can be placed on the roof surface 20. The plate can be flattened, which can be beneficial for using the base either under the membrane 40, as shown in FIG. 2, or over the membrane when tightening. Sometimes it can be beneficial to use the base over the membranes when there are obstructions. The flattened base can be configured without teeth or other protrusions. This can be beneficial to prevent damage to the roof surface or membrane material. The flattened base can also provide for a less-bulky and lighter device that can be more easily stored, packaged, or shipped.

The base 102 can also be configured to be slidable along the roof surface 20 or roof edge 22. As shown in the figures, the base can be smooth and lightweight with a large flat surface and a large smooth hook 36 to aid in sliding along the surface and in maintaining alignment on the roof edge with very little force applied. This can make it easy to adjust the pull-angle when tensioning the membrane 40 and to move to the next tensioning location along the working direction 26.

The base 102 can have a hook 36 for catching the edge 22 of the underlying surface 20. The hook can be on one side of the base as shown in the figures. The hook can be made by having a 90 degree break or bend in the plate. The base 102 can be placed flat on the roof surface 20 with the hook 36 placed over the edge 22. When operating the device, the hook can be pulled against the edge to create a secure anchor for tensioning the membrane.

The base 102 can also be flat on the other, non-hook side as shown in the figures. In such embodiments, the base can be flipped over to be used in the middle of the roof without the use of an edge as shown in FIG. 3. The lever 104 can be mounted on the bottom side of the base as also shown in FIG. 3. The operator can kneel 105 or stand on the plate behind the hook 36 to anchor the base to the roof surface.

The base can also have a mount 110 for receiving the fulcrum 110 of the lever 104. As shown in FIGS. 1-4, the mount can have multiple mounting locations 103 and can be configured to extend past the roof edge 22.

Figure 5:
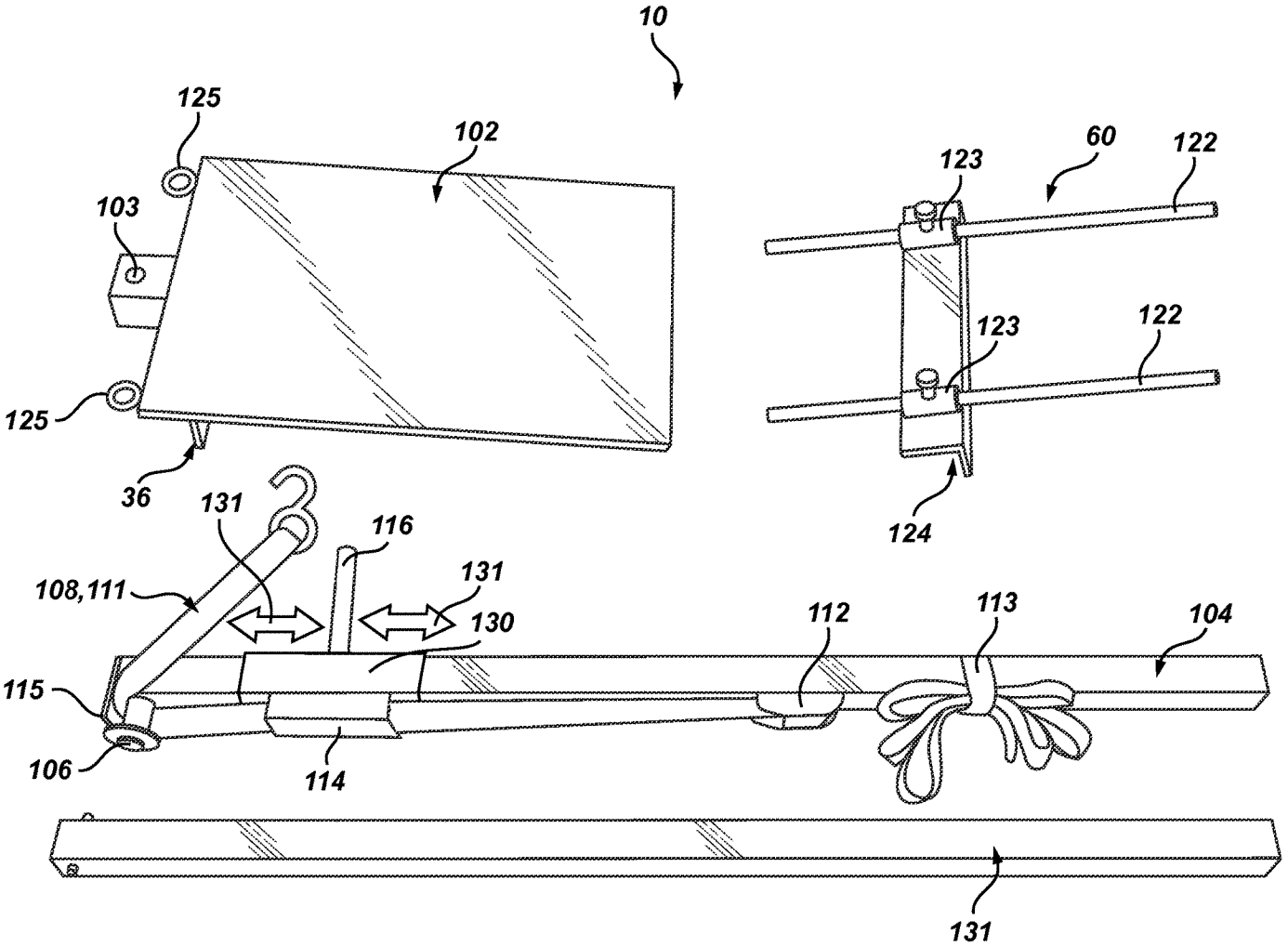
FIG. 5 shows a disassembled view of a roof membrane tensioning system in accordance with another embodiment of the present invention.
Figure 6:
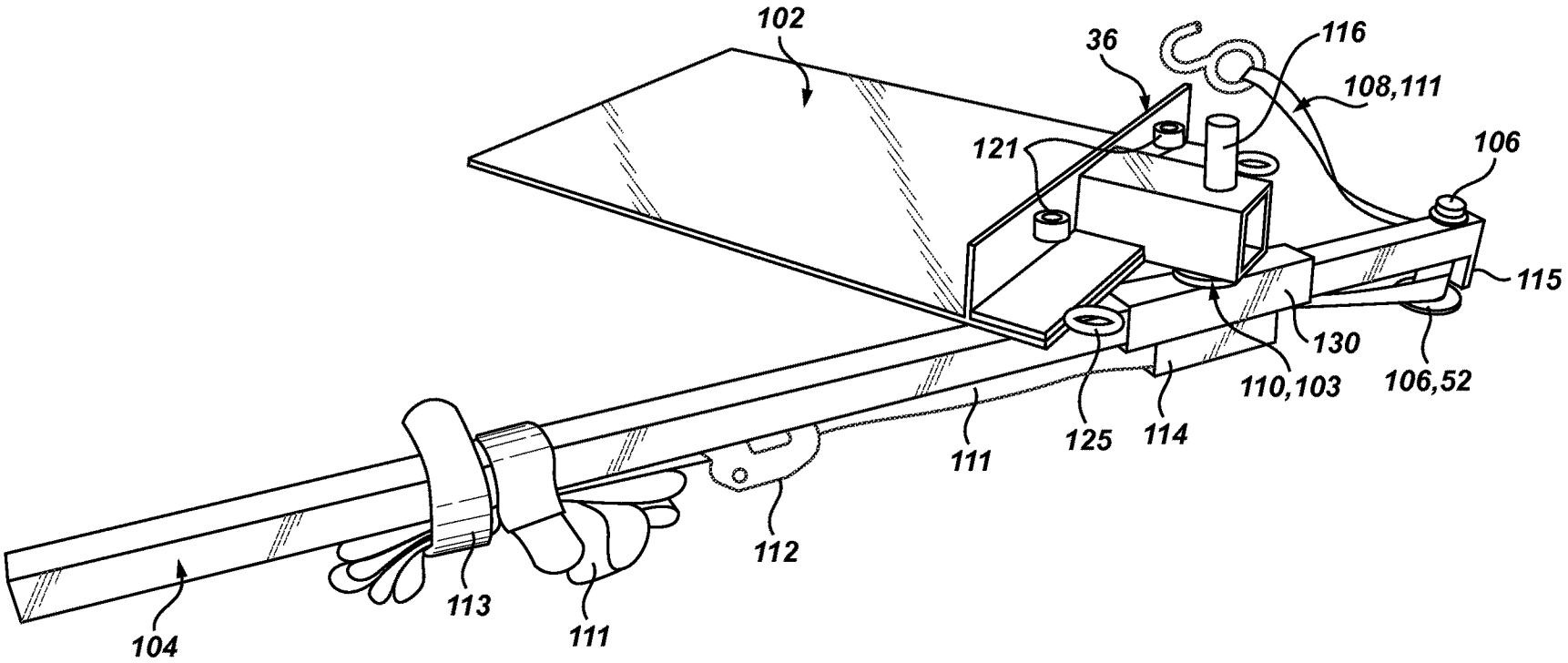
FIG. 6 shows a bottom perspective view of the roof membrane tensioning system of FIG. 5, without the adjustable bracket for parapet walls, that has been assembled to be used on a roof edge.
Figure 7:
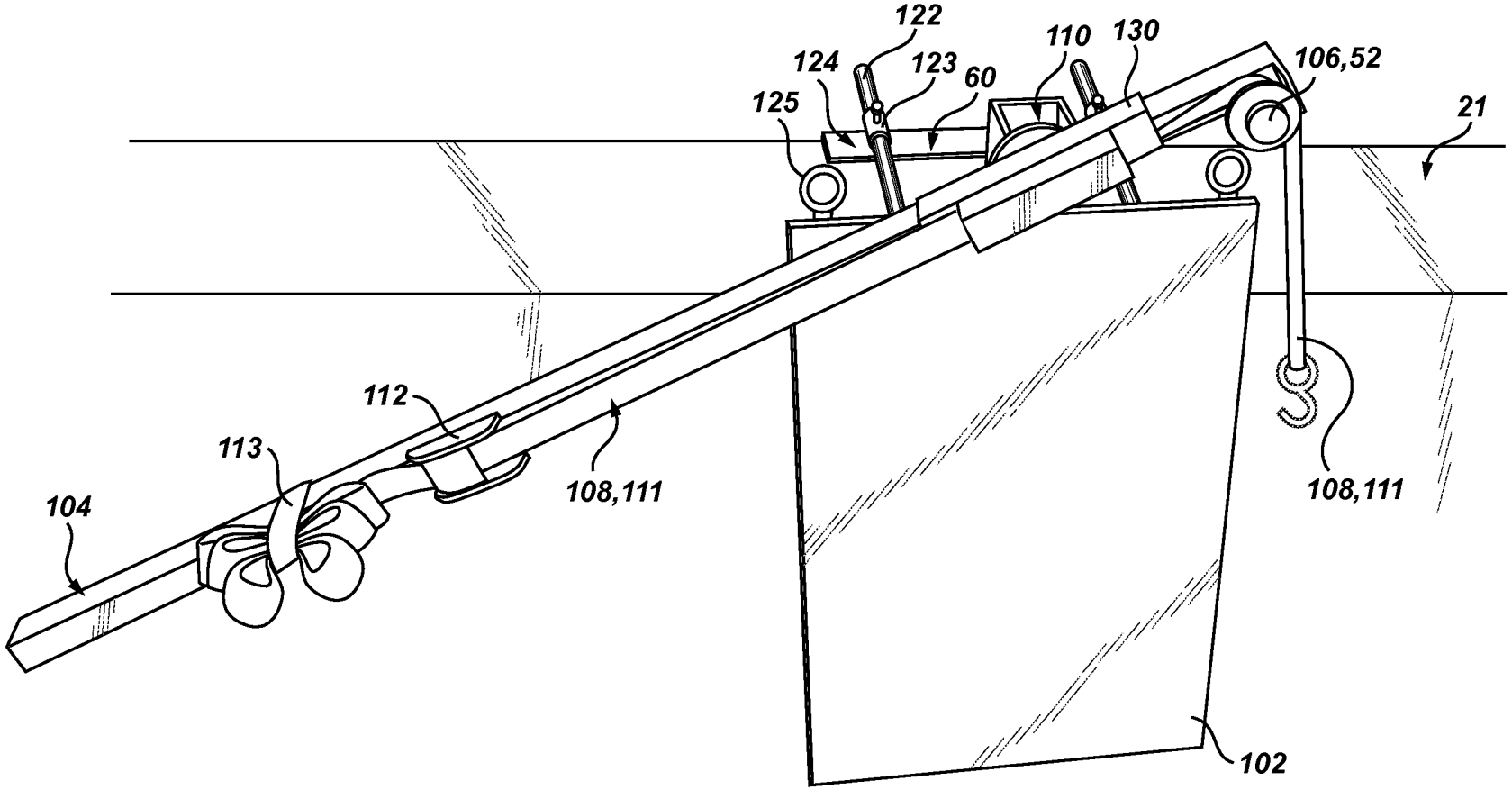
FIG. 7 shows a top perspective view of the roof membrane tensioning system of FIG. 5, with the adjustable bracket for parapet walls, assembled and positioned for use on a parapet wall.

As shown in FIGS. 5-7, the lever 104 can use a slidable fulcrum pin 116. The fulcrum pin can have a lever slide 130 that adjustably slides 131 along the lever arm 104. This can allow the pull-angle to be adjusted without repositioning the lever in another mounting location.

As shown in FIG. 5, the lever arm 104 can have an extension arm 131 that can be removably attached thereto.

The mount 110 can be configured to receive the lever so that the lever is operated substantially in the same plane as the underlying surface 20. This can allow the force applied to the lever to be low to the surface. As shown in FIGS. 1 and 2, this can in turn allow the operator 70 to be kneeling and keeping a low center of gravity, which can be a safer manner of working near a roof edge 22. This operation also provides for the lever force to be directed inwardly from the edge. As such, the operator's momentum can be directed inwardly, which can be safer in the event that the device or its components slips, breaks, or otherwise malfunctions.

The membrane connector 108 can be configured for removably grabbing the roof membrane 40. For example, as shown in FIGS. 1-3, the membrane connector can have gripping tool 109, such as locking pliers with flat jaws, for removably securing the membrane material to the membrane connector. The gripping tool can be removable from the membrane connector for interchanging other pliers or devices to be made part of the invention. For example, the locking pliers 109 can be connected to the membrane connector by an interchangeable couple 117, such as a quick link.

The membrane connector 108 can also have a strap 111 for transmitting the force from the gripping tool 109 to the working parts of the tool, such as a lever 104 mounted to a base 102. For example, as shown in FIGS. 1 and 2, a nylon strap 111 can be connected to the quick link 117 or locking pliers 109 and run to the resistance point 52 of the lever 104.

The strap 111 can be of variable length to accommodate the distance of the membrane 40 or membrane pull-tab 41 from where the base 102 is anchored. A clamp 112 can be used to tighten and hold the strap at the desired distance. For example, as shown in FIGS. 1-3, 5-7, a cambuckle 112 can be used as a clamp to set and lock the length of strap extending to the gripping tool 109. Excess strap can be secured by a strap holder 113. If the membrane 40 or pull-tab 41 is very close to the edge 22, then the strap can be shortened. If the membrane or pull-tab is far from the edge 22, then the strap can be lengthened. Additional lengths of strap could also be added to the interchangeable couple 117 if desired.

The means for moving the membrane connector 108 towards the edge can be a lever 104. The lever can be operated substantially in the same plane as the underlying surface 20 as shown in FIGS. 1-3 and 7. The lever can have a lever arm 104 with a nose 106. The nose can serve as the resistance point 52 of the lever, or the location where the operation of the lever is pulling on the membrane connector. As shown in FIGS. 1 and 2, the lever arm can have a length and fulcrum point 110 that is suitable for tensioning membranes and keeping operators a safe distance from the edge 22 of the roof 20. The lever can also have a means for securing and adjusting the membrane connector 108 or strap 111 to the resistance point 52 of the lever. For example, as shown in FIGS. 1-3 and 5-7, the lever can have a lever guide 114 and a nose guide 115 for holding the strap where it is operated by the lever at the resistance point and directing the strap so that excess strap is conveniently stored and secured out of the way.

The nose 106 can be configured for guiding and pulling the membrane connector 108 at the resistance point 52 of the lever 104. As shown in FIGS. 1-4 and 5-7, the nose can have a nose pin 106, which can be configured so that the strap 111 can be easily pulled through to adjust the length, and when the lever is operated, the nose pin 106 can have adequate strength to withstand the stress caused by operating the lever and a curvature to prevent damage or wear to the strap. As shown in FIGS. 1 and 2, the strap can be placed around the nose pin and inside the nose guide 115 to create a secure resistance pulling point. As shown, the strap can be directed over either side of the nose pin to accommodate operating the lever on either the right side of the base, as shown in FIG. 1, or the left side of the base, as shown in FIG. 2.

The roofing membrane tensioner 10 can also have a fulcrum 110 for operating the lever 104. As shown in FIGS. 1-4 and 5-7, the fulcrum can be attached to the lever arm 104 and can have a fulcrum pin 116. The fulcrum pin can be configured to insert into the mount 110 of the base 102. A spacer can also be used and configured to provide clearance between the lever arm and the base as well as to create a defined contact area for rotation when operating the lever.

The roofing membrane tensioner 10 can be configured so that operators 70 can operate the moving means at a safe distance from the roof edge 22. The force applied can be configured to be at least 50 cm from the edge 22 of the roof 20.

Figure 4:
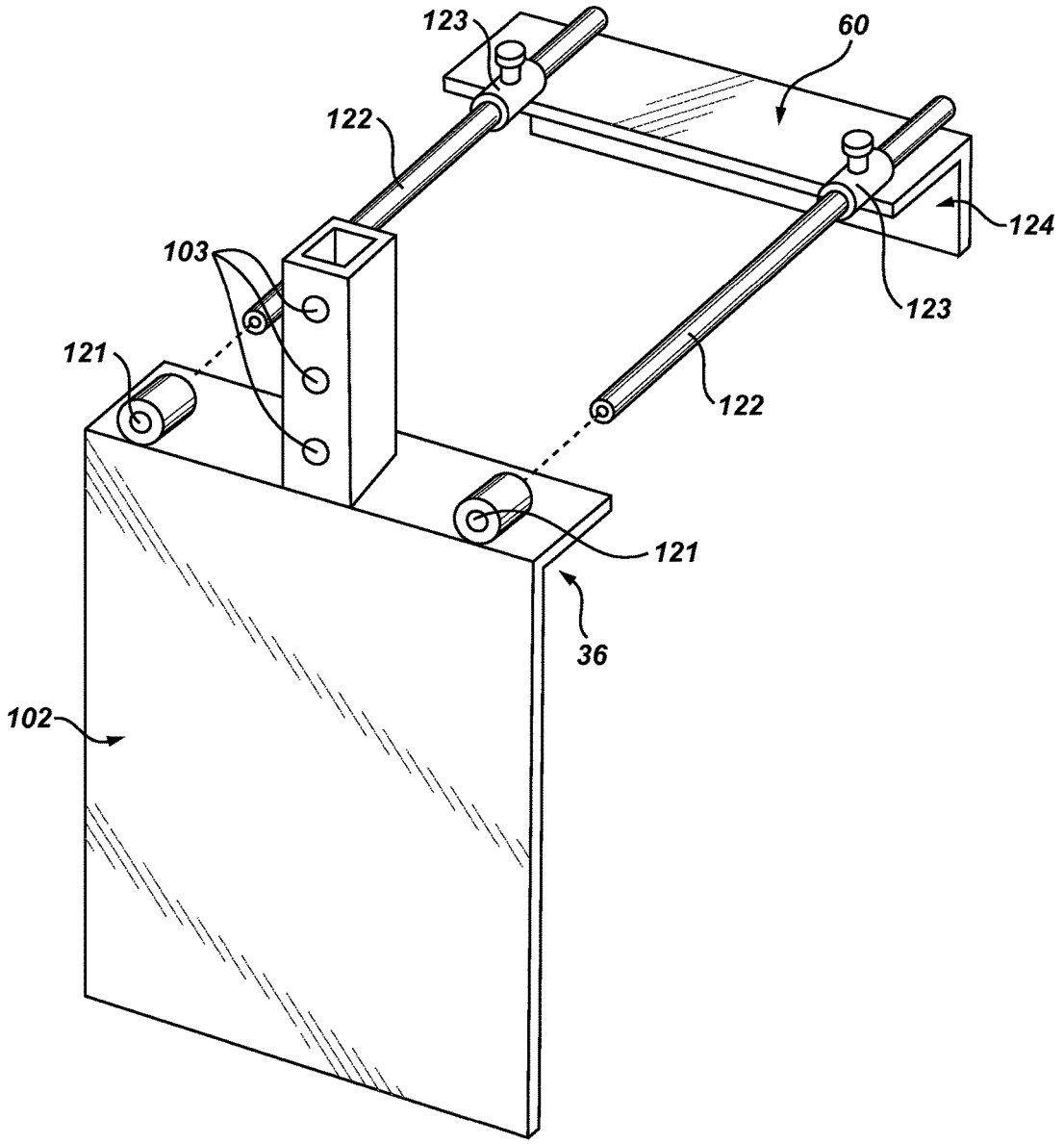
FIG. 4 shows a perspective view of a base and an adjustable bracket for vertical or parapet walls of a roofing membrane tensioner in accordance with another embodiment of the present invention.

The roofing membrane tensioner 10 can also be configured to operate in the vertical plane for tensioning roof membranes 40 on a parapet wall or a vertically-oriented underlying surface. As shown in FIGS. 4 and 7, an adjustable parapet wall adapter 60 can be used to secure the base 102 to a vertically-oriented underlying surface or a parapet wall 21. The parapet wall adapter can be removably attached to the base by connectors 122 for attaching between base receptors 121 and adapter receptors 123. The parapet wall adapter can have a secondary hook 124 that can secure the adapter to one side of the parapet wall. The base can be clamped to the parapet wall by tightening the secondary hook to the base. The roofing membrane tensioner can then be used to stretch the membrane towards the top of the parapet wall.

The invention also provides for a method for tensioning a roof membrane 40 towards an edge 22 of a roof surface 20 by securing a preceding tab of the roof membrane to the roof surface, hooking a slidable base 102 having a fulcrum 110 for an attached lever 104 to the edge, connecting a membrane connector 108 between a subsequent tab 41 of the roof membrane and the lever on one side of the fulcrum, and tensioning the roof membrane by applying inwardly 24 directed effort to the lever on the other side of the fulcrum. The invention can further provide for securing the subsequent tab to the roof surface.

The invention can be advantageous for increasing safety and improving efficiency and effectiveness when installing roof membranes 40. A smooth, flattened base 102 can provide for the ability to work over or under the membrane being installed, can prevent damage to the membrane or roof surface 20, and can allow for the base to be easily slid along the roof surface in the working direction 26. The use of a low-profile base and the operation of a lever 104 in the same plane of the roof surface can allow operators 70 to work in a kneeling position and direct their force inwardly 24 away from the roof edge 22. The membrane connector 108 can allow for a large adjustable length of pull from the base, and in conjunction with the slidable base, can allow of the pull-angle to be easily adjusted. The invention also can be advantageous by having fewer mechanical wear parts and less maintenance.

Two workers 70 can coordinate the use of the device 10 to tension the membrane 40 and the fastening of the membrane to the roof surface 20. One worker 70 can connect and unconnect the gripping tool 109 and install fasteners through the membrane pull-tab 41 and into the roof surface 20. The other worker 70 can slide the base 102 to the desired location and adjust the length of the strap 111 to set the desired pull angle, and then pull the lever 104 to tension the membrane 40.

The invention also provides for a roof membrane tensioning system 10 having a mounting means for positioning and adjusting a base 102 on a roof 20, a membrane connector 108, and a membrane tensioning mechanism for tightening the membrane towards an edge of a roof by applying force inwardly 24 from the edge 22.

The invention can also have security connectors 125 for attaching a safety rope to prevent the tool from accidentally falling off the roof.

Example:

In one exemplary embodiment, the roofing membrane tensioner 10 can have a base 102, lever 104, nose 106, membrane connector 108, and a fulcrum 110. The base can be made of a steel plate with the dimensions 3/16"×16"×24" to form the base and a steel tube with the dimensions 1/8"×2"×2" to form the mount 110. The steel plate can have a 90 degree break to one side to form the hook 36. The steel tube can be welded perpendicularly to the hook. Three 7/8 inch diameter holes can be drilled into the mount to form three mounting locations 103 for the fulcrum 110. The base plate 102 can be placed flat on the roof surface 20 with the hook extending over the roof to catch the edge 22 when work is performed.

The lever 104 can be made of a steel tube with the dimensions 1/8"×1"×1"×6'8" to form the lever arm 104, a steel tube with the dimensions 1/16"×1"×1"×24" to form the lever guide 114 for directing the strap 111 along the lever arm 104, and a steel plate with the dimensions 1/4"×1"×2 1/4" to form the nose guide 115 to help prevent the strap from falling off the nose 106. An inward pulling force 24 can be made by the user 70 kneeling behind the lever arm opposite the edge 22, while facing both the lever arm and edge. This usage of the tool can keep the operator's momentum directed inward away from the edge when operating the lever.

The nose 106 can be made of a bolt with the dimensions of 1/2"×4" to form the nose pin 106, a 1/2" locking nut, 1/2" flat washer, and a loosely fitted pipe with the dimensions of 1/2"×1 1/4" to form a roller for the nose pin. The strap 111 can be placed around the nose pin in order to create a resistance point 52 for utilizing the lever 104. If the lever is rotated around to pull from the other side of the base, then the strap can be grabbed and wrapped around the nose pin in the other direction. This allows the working direction 26 to be reversed along the edge 22 of the roof 20.

The membrane connector 108 can be made of a 1" nylon strap 111, a cambuckle for the clamp 112 to tighten and hold the strap at the desired length, an 8" locking plier with flat jaws for the gripping tool 109, a 5/16" quick link for the interchangeable couple 117 to interchange gripping tools, and 11/2"×8" strap holder 113, such as a hook and loop fastener. The locking plier 109 can be connected to the membrane sheet 40 or a pull-tab 41 of a pre-assembled membrane sheet. The quick link 117 can connect the locking plier to the strap. The strap can be run around the nose pin 106 and inside the nose guide 115, through the lever guide 114, and through the cambuckle 112. The length of the strap to the gripping tool can be set and locked by the cambuckle. Excess strap can be secured by the strap holder. Using a long strap can provide for a great amount of pull adjustability to pull membranes further from the edge 22. The ability to adjust the working length can provide the added capability to tension multiple pull-tabs that can be needed occur at the edge of a roof. These added tabs and added fasteners can be required to address wind uplift concerns and other specifications. If desired, using quick links, additional lengths of strap can be added.

The fulcrum 110 can be made of ¾"×4" round steel stock to form the fulcrum pin 116 and ¾"×2" diameter pipe segment to form a spacer. The fulcrum pin can be attached to the lever arm 104-2 to form the fulcrum point for the lever 104. The fulcrum pin can be inserted into the desired mounting location 103 on the mount 110 of the base 102.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A roofing membrane tensioner, comprising:

a) a base having a hook for catching an edge of an underlying surface;

b) a membrane connector; and c) a means for moving the membrane connector towards the edge by applying force inwardly from the edge, wherein the means for moving the membrane connector towards the edge is a lever operated in a plane that is substantially parallel to the underlying surface.

2. The roofing membrane tensioner of claim 1, wherein the force is applied at least 50 cm from the edge.

3. The roofing membrane tensioner of claim 1, wherein the base has a flat side for anchoring to a non-edge, middle area of the underlying surface and a hook side for anchoring to the edge of the underlying surface.

4. The roofing membrane tensioner of claim 1, wherein the base has a mount for connecting the lever.

5. The roofing membrane tensioner of claim 4, wherein the mount is a fulcrum for the lever.

6. The roofing membrane tensioner of claim 5, wherein the lever is configured to be slidably adjustable on the mount.

7. The roofing membrane tensioner of claim 5, wherein the mount has multiple mounting locations.

8. The roofing membrane tensioner of claim 1, wherein the base is configured to be slidable for repositioning the base on the underlying surface.

9. The roofing membrane tensioner of claim 1, wherein the base is configured to be teethlessly anchored to the underlying surface.

10. The roofing membrane tensioner of claim 3, wherein the membrane connector has an adjustable length.

11. The roofing membrane tensioner of claim 1, further comprising a parapet wall adapter for securing the base to a vertically-oriented underlying surface.

12. The roofing membrane tensioner of claim 11, wherein the parapet wall adapter is configured to removably attach to the base and to clamp the vertically-oriented underlying surface to the base.

* * * * *